US005156544A

United States Patent [19]

Jang

[11] Patent Number: 5,156,544

[45] Date of Patent: Oct. 20, 1992

[54] LIQUID FUEL COMBUSTOR

[75] Inventor: Kyung-Suk Jang, Seoul, Rep. of Korea

[73] Assignee: Samsung Electronics Co., Ltd., Kyonggi, Rep. of Korea

[21] Appl. No.: 736,796

[22] Filed: Jul. 29, 1991

[30] Foreign Application Priority Data

Jul. 31, 1990 [KR] Rep. of Korea ..... 90-11462

[51] Int. Cl.[5] ..... F23D 11/44

[52] U.S. Cl. ..... 431/208; 431/154; 431/331; 431/3

[58] Field of Search ..... 431/1, 41, 36, 11, 3, 431/154, 331, 332, 333, 335, 336, 337, 338, 339, 340, 117, 118, 208

[56] References Cited

U.S. PATENT DOCUMENTS 1,030,104 6/1912 Mantonya ..... 431/121
1,747,333 2/1930 Sundstrand ..... 431/118
3,186,399 6/1965 Peters ..... 431/118 X
3,352,345 11/1967 McLendon ..... 431/336 X

FOREIGN PATENT DOCUMENTS 805880 12/1936 France ..... 431/3
1026358 4/1953 France ..... 431/336
58-88525 5/1983 Japan .
0140209 6/1988 Japan ..... 431/3

*Primary Examiner*—Carl D. Price
*Attorney, Agent, or Firm*—Burns, Doane, Swecker & Mathis

[57] ABSTRACT

A liquid fuel combustor comprises a burner housing including an upper cylindrical body and a lower disc-shaped body threadedly coupled to the upper body. The lower body is provided with a reservoir at its bottom end to gather and store foreign materials such as fuel impurities and tars produced in the process of fuel combustion.

8 Claims, 4 Drawing Sheets 100A
100
21
22
37
22a
38a
39
36
36a
34
32d
38
38b
40
31
59a
59
35
40a
27
H
43
43a
44d
26
42
49
24
44b
80
44
28
44a

LIQUID FUEL COMBUSTOR

FIELD OF THE INVENTION

The present invention relates to a liquid fuel combustor.

DESCRIPTION OF THE PRIOR ART

Japanese Patent Publication No. 58-88525 discloses a typical liquid fuel combustor comprising, as shown in FIG. 1, an ultrasonic atomizer 9 disposed to feed fuel particulates into the gasification chamber 2 defined by a circular burner wall 1. Formed through the atomizer 9 is a fuel flow path 11 which is exposed to the gasification chamber 2 at its one end and coupled, at the other end, to a fuel supply line (not shown) which in turn is connected to a fuel pump. The atomizer 9 has a radial inner end extending through an opening 6 toward the gasification chamber 2. Further, the burner wall 1 includes a pair of combustion air inlets 12 and 13 lying perpendicularly to the atomizer 9 in a common plane (i.e., the plane of the paper).

These combustion air inlets 12 and 13 faces toward one another, with their axes offset to a predetermined extent. A conventional blower 7 supplies a controlled amount of pressurized air into the gasification chamber 2 through an air supply pipe 16 and then through the opening 6 as well as combustion air inlets 12 and 13.

During operation of such a liquid fuel combustor as set forth above, an increase in the gasification chamber temperature to a certain level will cause the fuel pump to feed liquid fuel to the radial inner end of the atomizer 9 via the fuel flow path 11.

Since the atomizer 9 has an ultrasonic oscillation circuit for generation of an ultrasonic field, the liquid fuel reaching the radial inner end of the automizer 9 is subject to an atomization effect and then introduced into the gasification chamber in a particulate state. A relatively small amount of air flowing through the smaller diameter pipe 16 assists to direct the atomized fuel particulate to the gasification chamber 2. Another portion of the combustion air supplied from the blower 7 is admitted into the gasification chamber 2 through the upper combustion air inlet 12, with the remaining portion of the combustion air admitted through the lower combustion air inlet 13. As described earlier, because the axes of the upper and lower inlets are offset from one another in a common plane and disposed perpendicular to the axis of the atomizer 9, the combustion air admitted through each of the inlets tends to form a spiral vortex with the fuel particulate.

The conventional liquid fuel combustors of the construction explained above, however, are disadvantageous in many respects.

Specifically, when the liquid fuel combustor is in use for a long period of time, non-gasified fuel particulare or tar produced in the process of fuel combustion tends to be deposited on the bottom surface of the gasification chamber 2.

Not only does the deposited material create white gas at the initial stage of ignition but it also produces a yellow flame or soot containing a variety of toxic emissions, e.g., CO, CO2, NO, NO2 and the like, thereby polluting the indoor air around the fuel combustor or heater. Moreover, an increase in the amount of foreign materials deposited on the bottom surface of the gasification chamber 2 often results in a lowering of the temperature at the particulate landing region, which may lead to an incomplete gasification of the atomized fuel.

SUMMARY OF A PREFERRED EMBODIMENT OF THE INVENTION

Accordingly, it is an object of the present invention to provide an liquid fuel combustor which is able to remove tar materials or impurities accumulated on the inner surface of the burner body during combustion, thereby preventing temperature fluctuation at the fuel particulate impinging region. This makes it possible to materialize a complete gasification and hence effective combustion of the atomized fuel, which would otherwise create toxic and odorous gas, soot or yellow flame.

With this object in view, the liquid fuel combustor in accordance with the present invention comprises an upper cylindrical body defining a part of gasification chamber therein, said upper body being opened at its top and bottom ends. A nozzle assembly is mounted on said upper body for feeding combustion air and liquid fuel into the gasification chamber to produce an air-fuel mixture. A sheath heater is embedded circumferentially in said upper body for heating the air-fuel mixture to facilitate gasification of the liquid fuel. A burner head is located on the top end of said upper body, said burner head having an array of flame generation holes distributed along the circumference thereof. A throttle member is attached to the lower surface of said burner head for directing the heated air-fuel mixture each of the flame generation holes of said burner head through a central throttling path. A lower body is removably fastened to the bottom end of said upper body to define a remaining part of the gasification chamber, said lower body having a reservoir for gathering and storing foreign materials contained in the air-fuel mixture.

Other features and objects of the present invention will become apparent from the following description of the preferred embodiment taken in conjunction with the accompanying drawings.

DETAILED DESCRIPTION OF THE PREFERRED EMBODIMENT

Figure 1:
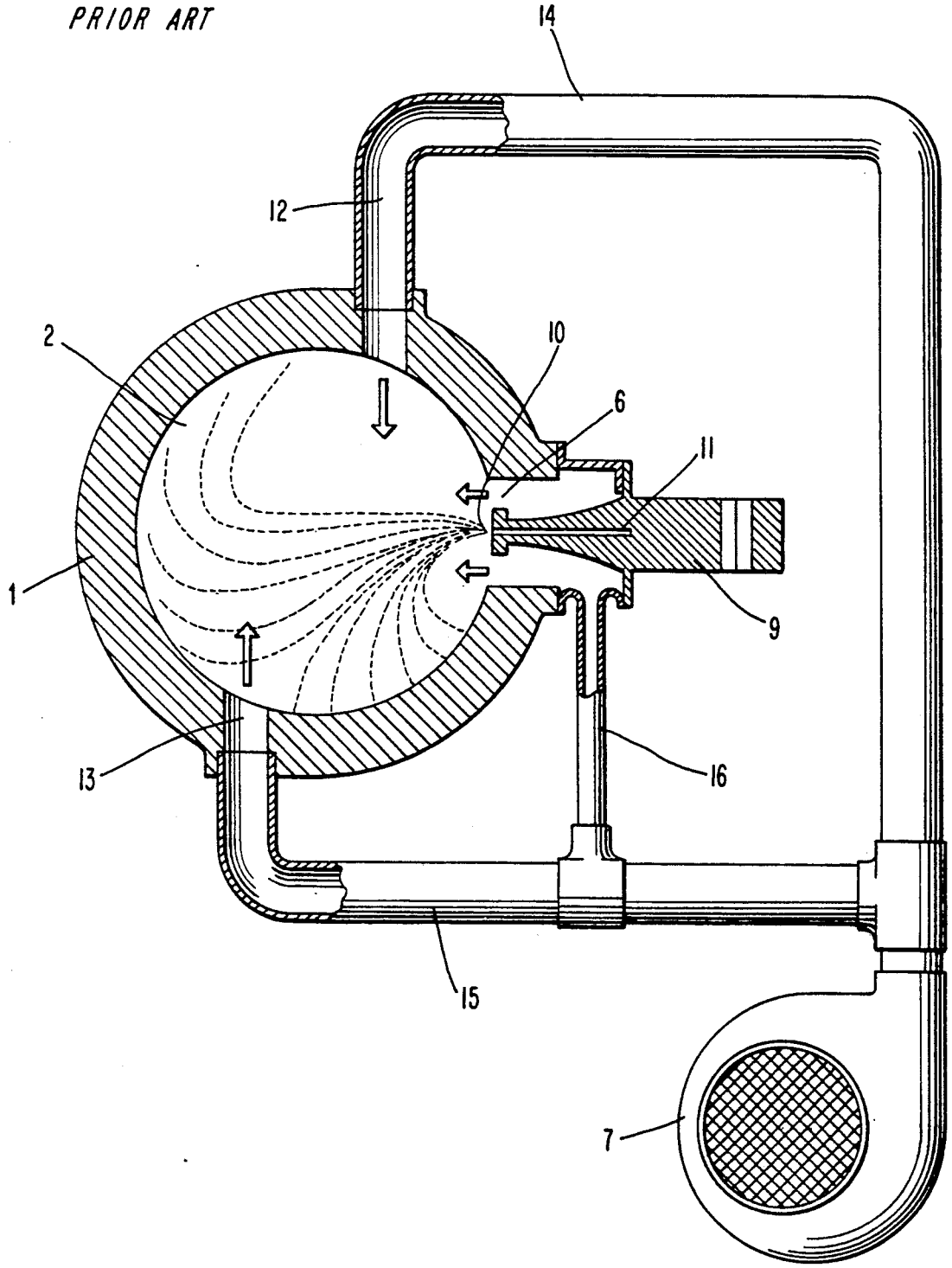
FIG. 1 PRIOR ART
FIG. 1 is a horizontal sectional view through a conventional liquid fuel combustor, with portions thereof removed for clarity and simplicity.
Figure 2:
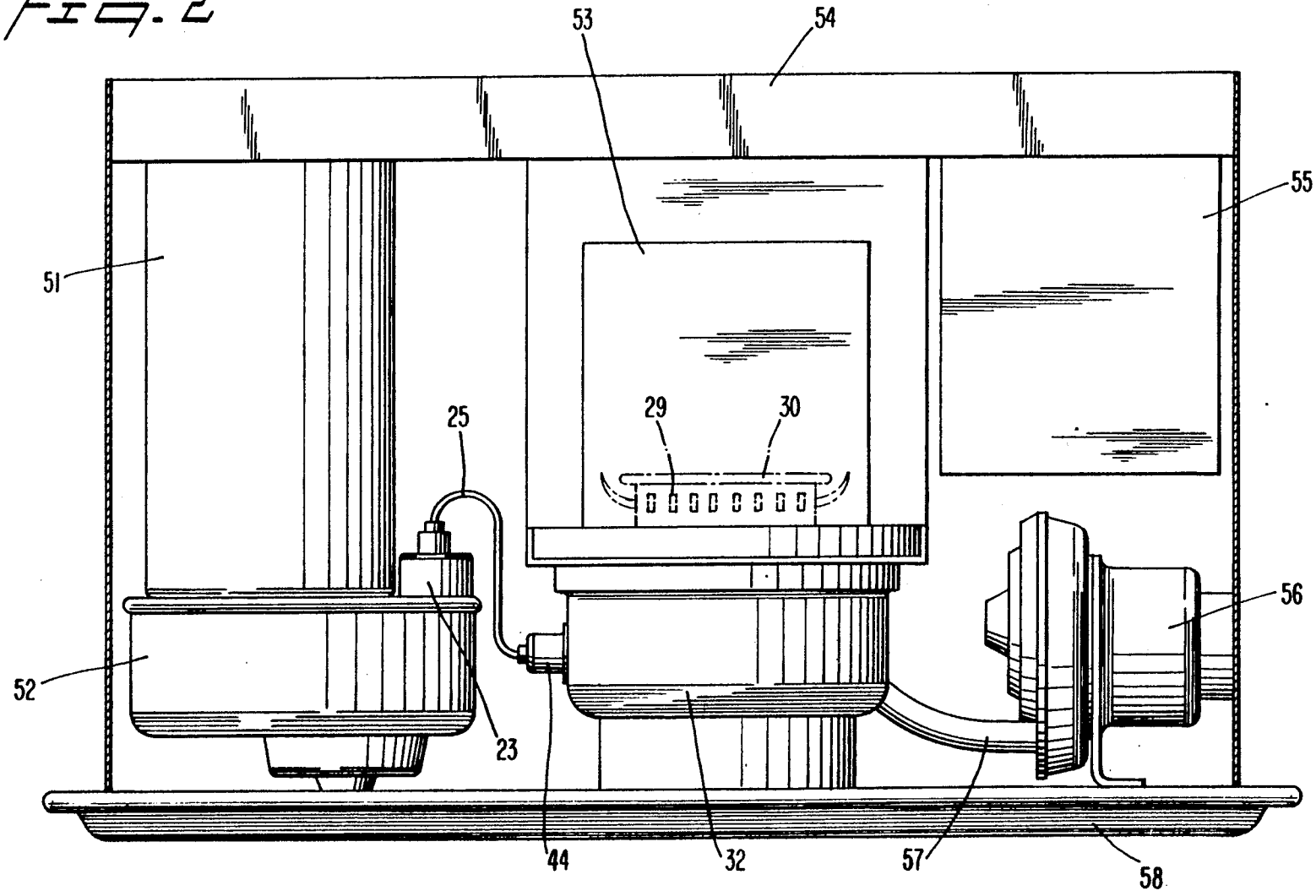
FIG. 2 is a schematic view illustrating the overall construction of a liquid fuel combustor in accordance with the present invention.
Figure 3:
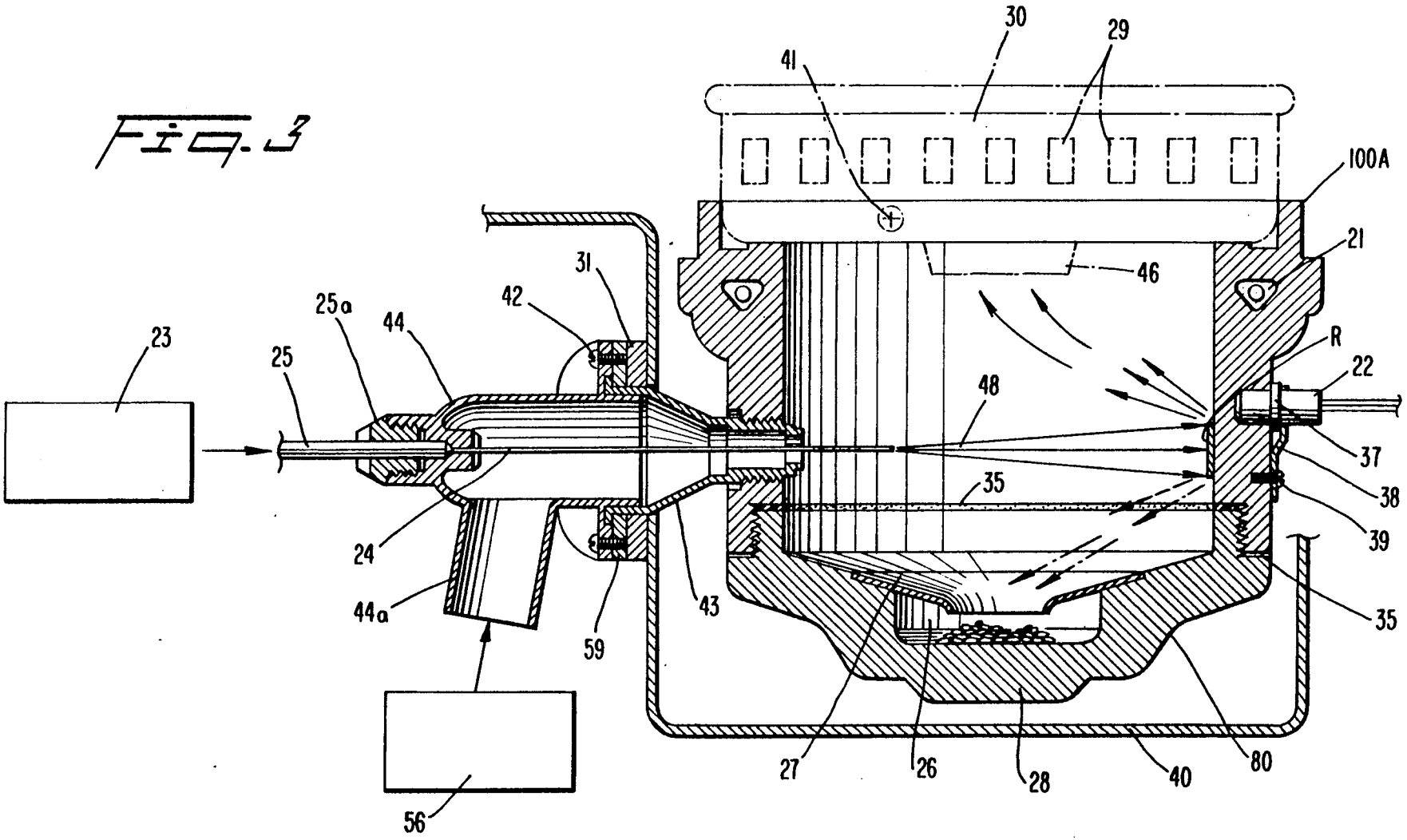
FIG. 3 is a vertical sectional view showing an embodiment of the burner assembly incorporated in the liquid fuel combustor according to the present invention.
Figure 4:
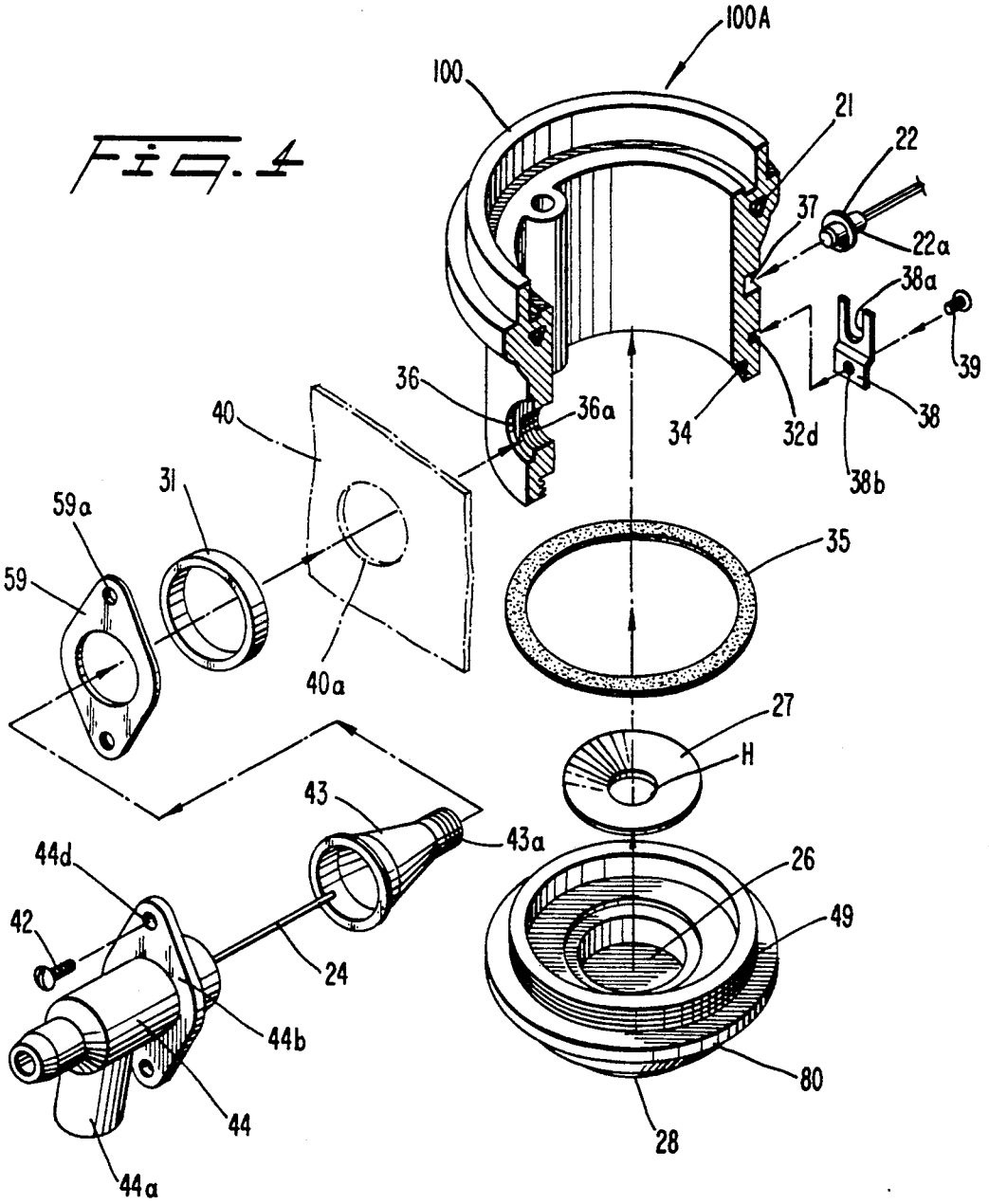
FIG. 4 is an exploded perspective view of the burner assembly shown in FIG. 3, with a portion of the burner body removed for clarity.

Referring now to FIG. 2 and 3, there is shown a liquid fuel combustor of the present invention which comprises a sheath heater 21 connected to a power source for increasing the temperature the gasification chamber defined within the burner housing 100A. If the gasification chamber is preheated to a given temperature, a microprocessor constituting the control part 55 will come into operation to make the blower 56 provide combustion air into the gasification chamber through an air hose 57 and inlet pipe **44*a*. At this moment, the fuel pump 23 begins to suck up a controlled volume of liquid fuel from the oil reservoir 52 and then deliver it via oil pipe 25 to a nozzle 24 of the nozzle assembly 44 which acts to spray liquid fuel toward the impinging region R on the inner surface of the burner housing 100A in an atomized state. The atomized fuel is subsequently mixed with the combustion air supplied through the inlet pipe 44***a* while being subject to gasification with the aid of thermal energy. The resulting air-fuel mixture will be directed to an array of flame generation holes 29 that are arranged to produce uniform flame upon ignition of the air-fuel mixture. As known in the art, a variety of information data indicative of operating conditions or indoor temperature may be displayed on the display part 54 through the use of, e.g., liquid crystal display elements or light emitting diodes under a control of the control part 55. It should be appreciated that the oil reservoir 52, the burner housing 100A and the blower 56 are all carried by a single base plate 58 as best shown in FIG. 2. With reference to FIGS. 3 and 4, there is shown in detail a burner assembly for use in the liquid fuel combustor in accordance with the present invention. The burner assembly includes an upper body 100 of cylindrical shape having an internal thread 34 at its lower marginal end. Detachably coupled to the upper body 100 is a dish-shaped lower body 80 which has an external thread 49 engageable with the external thread 34 of the upper body 100.

It is important that the lower body 80 has a downwardly extending projection 28 at its central portion with a view to enabling the user to readily handle the lower body 80 in the process of thread coupling or dismantling as set forth above. Further, the lower body 80 is provided with a depression or pit 26, at its bottom surface, which serves to gather such foreign materials as non-gasified fuel particulates present in the atomized liquid fuel emerging from the nozzle 24, impurities contained in the liquid fuel and tars produced in the course of fuel combustion. A guide plate 27 having a central through-hole H is mounted on the inner inclined surface of the lower body 80 in order to facilitate gathering of the foreign materials within the depression 26. The lower body 80 of the above construction will be threadedly coupled to the upper body 100, with a packing member 35 made of natural rubber or silicon rubber being inserted between the upper and lower bodies for the purpose of hermetic seal.

As clearly shown in FIGS. 3 and 4, a sheath heater 21 is embedded in the upper body 100 along the circumference thereof to provide thermal energy into the gasification chamber. Located on the top end of the upper body 100 is a burner head 30 having an array of equally spaced flame generation holes 29. A throttling member 46 is attached to the burner head 30 by means of screws 41 so as to direct the air-fuel mixture to the flame generation holes 29 through a central throttling path, as illustrated in FIG. 3.

In addition, a temperature sensor 22 is seated on a recess 37 formed through the wall of the upper body 100.

This temperature sensor 22 may be held in place by means of a bracket 38 which has a slot 38*a* opened at its top end.

When a screw 39 is inserted through a screw hole 38*b* of the bracket 38 and then threaded into a fastening hole 32*d* of the upper body 100, the bracket 38 acts to press the flange 22*a* of the temperature sensor 22 against the upper body 100 of that the temperature sensor 22 can be secured in place.

The upper body 100 has a threaded opening 36 into which a nozzle holder 43 is threadedly inserted as shown in FIG. 3. Connected to the nozzle holder 43 is a nozzle assembly 44 which comprises an air inlet pipe 44*a* associated with the blower 56 and a nozzle 24 associated with the fuel pump 23 through an oil pipe 25. The nozzle 24 is disposed in a horizontal direction and extends into the gasification chamber at one end thereof.

In order to fasten the lower body 80, the burner head 30, the temperature sensor 22 and the nozzle assembly 44 to the upper body 100, the lower body 80 is first assembled to the lower marginal end of the upper body 100 with the packing member 35 inserted therebetween. Then, the burner head 30 carrying the throttling member 46 is seated on the top end of upper body 100. The temperature sensor 22 is held in place by means of the bracket 38 screwed on the wall of the upper body 100. As is conventional, the temperature sensor 22 functions to detect the actual temperature within the gasification chamber which is transmitted to the control part as an electrical signal. The control part is adapted to control the activation of the sheath heater 21 so as to keep the temperature range within the gasification chamber on the order of 240° C. to 260° C. Specifically, the sheath heater 22 will be disconnected from the electrical power source in case the temperature within the gasification chamber exceeds 260° C., whereas the sheath heater 22 will remain connected to the electrical power source if the temperature is less than 240° C.

The nozzle holder 43 is attached to the upper body 100 by way of inserting a bracket 59 and a packing 31 around the nozzle holder 43, positioning the nozzle holder 43 into the larger diameter hole of the burner cover 40 and finally effectuating a threaded engagement between the external thread 43*a* of the nozzle holder 43 and the internal thread 36*a* of upper body 100. As a result, the packing 31 forms a hermatic seal between the bracket 59 and the burner cover 40 and hence prevents the exterior space from communicating with the interior space separated by the burner cover. The nozzle assembly 44 is then fastened to the nozzle holder 43 by threading a screw 42 into the thread holes 44*d* and 59*a*.

It should be noted that the elongate nozzle 24 is to be positioned in place prior to attaching the nozzle assembly 44 to the upper body 100, with the oil pipe 25 being coupled to the nozzle assembly through the use of a coupling member 25*a*. This will make it possible to form a length of fuel flow path for feeding the pressurized liquid fuel from the fuel pump 23 to the nozzle 24 from which the liquid fuel is sprayed toward the fuel impinging region R as indicated by arrows 48.

In operation, if the liquid fuel combustor is plugged to the electrical power source, the sheath heater 21 begins to radiate thermal energy in the gasification chamber. An increase in the gasification chamber temperature to a predetermined level is detected and converted into an electrical signal by the temperature sensor 22. In response to the electrical signal, the microcomputer in the control part 55 acts to cause the blower 56 to supply combustion air into the gasification chamber through the air inlet pipe 44*a* and the nozzle holder 43. The combustion air admitted into the gasification chamber forms an upward flow under the action of thermal energy radiated from the sheath heater 21. At this moment, the fuel pump 23 operates to suck up a volume of liquid fuel and then feed the pressurized liquid fuel through the oil pipe 25 to the nozzle 24. The liquid fuel is sprayed into the gasification chamber by the nozzle 24 and subsequently mixed with the combustion air to form an air-fuel mixture. The resulting air-fuel mixture is delivered to the flame generation holes 29 at which the air-fuel mixture is burnt to flame after ignition. During the course of gasification and combustion, such foreign materials as impurities, tars and non-gasified fuel particulates are precipitated as indicated by dotted arrows and gathered within the depression 26.

In order to remove the foreign materials stored within the depression 26, the nozzle assembly 44 should be first disassembled from the upper body 100 together with the nozzle holder 43. Then, the temperature sensor 22 is detached by way of releasing or loosening the screw 39, after which the burner body may be taken out from the burner cover 40. The next process is to dismantle the lower body 80 from the upper one 100 so that the foreign materials stored at the depression 26 of the lower body 80 can be exposed to the atomosphere. Finally, the foreign materials are swept off through the use of, e.g., a cleaning patch.

Reverse steps are carried out to assemble the dismantled parts or components.

As set forth above, the liquid fuel combustor in accordance with the present invention makes it possible to inhibit or prevent temperature fluctuation at the fuel impinging region R due to the sticking of foreign materials, mainly because the foreign materials can be gathered together and removed in a periodic manner by way of dismantling the lower body 80 from the upper body 100.

Accordingly, the atomized fuel particulates sprayed from the nozzle 24 are fully gasified at the very moment they impinges on the fuel impinging region R maintained at the temperature level ranging from 240° C. to 260° C. This means that the present liquid fuel combustor is capable of inhibiting the production of toxic emissions, soots, yellow flame and the like, which would otherwise pollute the ambient air.

While the present invention has been described with reference to a particular embodiment, it should be apparent to one skilled in the art that many changes and modifications may be made without departing from the spirit and scope of the invention as defined in the claims.

What is claimed is:

1. A liquid fuel combustor including a burner assembly communicable with a fuel source, said burner assembly comprising:

a burner housing defining a gasification chamber therein;

nozzle means mounted on said burner housing for feeding combustion air and liquid fuel into said gasification chamber to provide therein an air-fuel mixture;

a heater for heating said burner housing and air-fuel mixture disposed therein to facilitate gasification of the fuel; and a burner head communicating with said gasification chamber and including flame generation holes through which the heated air-fuel mixture is directed;

said burner housing including an upper body and a lower body removable from said upper body, said lower body including a downward depression forming a reservoir for receiving and collecting particulates contained in the air-fuel mixture, and a funnel-like plate disposed atop said depression for gathering the particulates, said plate having a central hole therein.

2. A liquid fuel combustor according to claim 1, wherein said nozzle means includes a fuel nozzle extending into said gasification chamber and arranged to eject said fuel into contact with a side wall of said gasification chamber.

3. A liquid fuel combustor according to claim 1, wherein said heater is embedded in said upper body and extends circumferentially therearound.

4. A liquid fuel combustor according to claim 1, wherein said nozzle means and said heater are mounted on said upper body.

5. A liquid fuel combustor comprising a burner assembly communicating with a fuel source, said burner assembly comprising an upper cylindrical body defining a part of a gasification chamber therein:

a nozzle assembly mounted on said upper body for feeding combustion air and liquid fuel into said gasification chamber to provide an air-fuel mixture;

a heater embedded circumferentially in said upper body for heating the air-fuel mixture to facilitate gasification of the fuel;

a burner head located on a top end of said upper body, said burner head having an array of flame generation holes distributed along a circumference thereof through which the heated air-fuel mixture is directed; and a lower body removably fastened to a bottom end of said upper body to define a remaining part of the gasification chamber, said lower body having a depression forming a reservoir at a bottom surface of said lower body for receiving particles contained in said air-fuel mixture, and an inclined guide plate having a central through-hole, said guide plate being positioned within said lower body above said depression for gathering the particles into said depression.

6. A liquid fuel combustor according to claim 5, further comprising a temperature sensor mounted on a wall of said upper body for detecting the actual temperature within the gasification chamber.

7. A liquid fuel combustor according to claim 5, wherein said upper body is threadedly engaged with said lower body with a packing inserted therebetween.

8. A liquid fuel combustor according to claim 7, wherein said packing is made of natural rubber.

* * * * *